US010648111B2

(12) United States Patent
Fujiwara et al.

(10) Patent No.: US 10,648,111 B2
(45) Date of Patent: May 12, 2020

(54) STAIN REMOVAL DEVICE

(71) Applicants: QINGDAO HAIER WASHING MACHINE CO., LTD., Qingdao, Shandong (CN); AQUA CO., LTD, Chiyoda-ku, Tokyo (JP)

(72) Inventors: Masahiro Fujiwara, Tokyo (JP); Masakazu Yamamoto, Tokyo (JP); Masaru Noro, Tokyo (JP)

(73) Assignees: QINGDAO HAIER WASHING MACHINE CO., LTD., Shandong (CN); AQUA CO., LTD, Tokyo (JP)

( * ) Notice: Subject to any disclaimer, the term of this patent is extended or adjusted under 35 U.S.C. 154(b) by 99 days.

(21) Appl. No.: 16/060,901

(22) PCT Filed: Dec. 9, 2016

(86) PCT No.: PCT/CN2016/109150
§ 371 (c)(1),
(2) Date: Jun. 8, 2018

(87) PCT Pub. No.: WO2017/097247
PCT Pub. Date: Jun. 15, 2017

(65) Prior Publication Data

US 2018/0363187 A1 Dec. 20, 2018

(30) Foreign Application Priority Data

Dec. 9, 2015 (JP) ..... 2015-240094

(51) Int. Cl.
*A47L 25/00* (2006.01)
*D06F 3/04* (2006.01)
(Continued)

(52) U.S. Cl.
CPC ..... *D06F 7/04* (2013.01); *D06F 5/02* (2013.01); *A47L 25/00* (2013.01); *D06F 3/04* (2013.01); *D06F 43/002* (2013.01)

(58) Field of Classification Search
CPC ... A47L 25/00; D06F 3/04; D06F 5/02; D06F 7/04; D06F 43/002
(Continued)

(56) References Cited

U.S. PATENT DOCUMENTS 5,122,158 A 6/1992 Kuroda et al.
2015/0292132 A1 10/2015 Lee et al.
2017/0275807 A1* 9/2017 Fujiwara ..... D06F 7/04

FOREIGN PATENT DOCUMENTS

CN 2302969 Y 6/1999
CN 104411596 A 3/2015
(Continued)

OTHER PUBLICATIONS

International Search Report and Written Opinion for PCT/CN2016/109150 dated Mar. 14, 2017.
(Continued)

*Primary Examiner* — Levon J Shahinian
(74) *Attorney, Agent, or Firm* — Arent Fox LLP

(57) ABSTRACT

The present disclosure provides a stain removal device capable of performing partial beating and washing on a cloth product, automatically supplying liquid and applying a beating force to a stain portion appearing on the cloth product, preventing liquid leakage and realizing miniaturization. The stain removal device includes: a cassette mechanism, which includes a head portion having a beating surface and a water supply bottle for accommodating liquid, where water supply paths are from the water supply bottle and throughout the head portion; and a device main body, which includes a vibration unit mountable by pressing the cassette
(Continued)

mechanism and detachable by pulling out the vibration unit and is configured to apply a vibration to the cassette mechanism towards a direction substantially orthogonal to the beating surface of the head portion through supplied electric power.

2 Claims, 10 Drawing Sheets

(51) Int. Cl.
*D06F 5/02* (2006.01)
*D06F 7/04* (2006.01)
*D06F 43/00* (2006.01)

(58) Field of Classification Search
USPC ..... 15/104.93, 104.94; 68/28, 200
See application file for complete search history.

(56) References Cited

FOREIGN PATENT DOCUMENTS

| | | | |
|---|---|---|---|
| CN | 204551062 | U | 8/2015 |
| CN | 104995346 | A | 10/2015 |

OTHER PUBLICATIONS

Copyright © 1996-2018 Lion Corporation, Internet URL:http//www.lion.co.jp/a/seihin/brand/025/06.htm.
Web.archive.org/web/20170211155538, Internet URL:http://aqua-has-com/coton/.
Extended European Search Report received in European Patent Application No. 16872436 dated Jun. 14, 2019.

* cited by examiner (a)

STAIN REMOVAL DEVICE

TECHNICAL FIELD

The present disclosure relates to a stain removal device capable of performing partial beating and washing on a cloth product, automatically supplying liquid and a tapping force to a stain portion formed on the cloth product, preventing liquid leakage and realizing miniaturization.

BACKGROUND

In the case that dirt is partially adhered to a cloth product and becomes stained. Compared with washing the entire cloth product, it is generally preferable to only partially wash the stain portion early from aspects of a decontamination effect and operation efficiency.

An exemplary stain removal system capable of partially washing the cloth product is composed of a bottle for accommodating a detergent and an absorbing sheet. A pore for supplying the detergent is formed in the top end of the bottle. The stain removal system can beat the stain portion with the top end of the bottle in such a state that the absorbing sheet is abutted against the bottom. The detergent is supplied to the stain portion by using the beating action. The supplied detergent is penetrated into the cloth product, and is absorbed into the absorbing sheet together with the dirt that constitutes the stain portion.

However, the stain removal system requires a hand holding the bottle to move up and down rapidly to make the stain removing action, so the beating speed and the beating force are not constant, there is a limit in the beating speed, and there is a deviation in stain removing degrees or a problem of hand fatigue.

Therefore, an alternative stain removal device capable of keeping the hand untired and performing stain removing operation always with a fixed beating force and a fixed beating speed may be used. FIG. 7 is a perspective view illustrating an overall appearance of the device. FIG. 8 is a perspective view illustrating exploded structures. The stain removal device 100, as shown in FIG. 7, is substantially cylindrical in such a state that a cover body 70 is mounted on a device main body 3. The stain removal device 100 includes a cassette mechanism 1 and the device main body 3. The cassette mechanism 1 includes a head portion 11 formed with a beating surface 21*a* as shown in FIG. 8 in which the cover body 70 is removed, and a water supply bottle 12 capable of accommodating liquid. The device main body 3 may be configured to be mounted by pressing the cassette mechanism 1 and pulled out for separation, and is provided with a vibration unit 31 which vibrates the cassette mechanism 1 towards a direction substantially orthogonal to the beating surface 21*a* of the head portion 11 through supplied electric power. Furthermore, with the vibration generated by the vibration unit 31 to the cassette mechanism 1, the liquid is supplied to the beating surface 21*a* of the head portion 11 from the water supply bottle body 12 through internal water supply paths.

Therefore, the action for beating a stain removing object by the head portion 11 may be automated, so as to make the beating force and the beating speed uniform. Furthermore, the action is effortless, and compact high-speed beating and washing which may not be realized manually may be effectively performed.

It should be noted that the stain removal device 100 is further provided with an external cover body 70 and a waterproof cover 50 in addition to the device main body 3 and the cassette mechanism 1. The external cover body 70 may be removed from the device main body 3 as shown in FIG. 8 when the stain removing operation is performed, and may be mounted on the device main body 3 as shown in FIG. 7 when the stain removal device 100 is carried, thereby effectively preventing water from leaking to the outside of the device or from impacting the cassette mechanism 1 when the stain removal device 100 is carried.

In addition, the waterproof cover 50 may be detachably mounted at a position where the waterproof cover 50 surrounds a side surface of the head portion 11, so as to prevent splashing of the water, and achieves an effect of defining a relative position of the head portion 11 relative to the stain removing object during use.

However, the stain removal device 100 has the following shortcomings to be improved because of the component configuration thereof.

FIG. 9 is a front view illustrating the component configuration. FIG. 10 is a perspective view illustrating states of assembling and disassembling. The water supply bottle 12 of the cassette mechanism 1, as shown in FIG. 9 and FIG. 10(*a*), is composed of a bottle main body 24*a* and a cover body 24*b* for opening and closing the bottle main body 24*a*. A thread arranged at the inner circumference of an outer barrel 24*b*1 of the cover body 24*b* and a thread 24*a*1 arranged at the periphery of the end portion 24*a*1 of the bottle main body 24*a* are threadedly engaged, an inserting portion 22 of the head portion 11 is pressed into a head inserted portion 25 arranged at a position at an opening in the end portion of the cover body 24*b* and is embedded as shown in (b) of the figure, thereby constituting the stain removal device 100, and the these components may be cleaned after being disassembled. It should be noted that the numeral 20 in FIG. 9 represents a sealing member.

The inserting portion 22 is intermittently provided with concavo-convex parts 22*a* along an axial direction. The head portion 11 is fitted and retained in the head inserted portion 25 through elasticity of resin of the concavo-convex parts 22*a*.

Therefore, when the water supply bottle 12 is pulled out of the device main body 3, if the water supply bottle 12 is pulled with the head portion 11 being clamped, it just needs to pull out the entire cassette mechanism 1 as shown in FIG. 10(*c*). However, as shown in (b) of the figure, if the inserting portion 22 of the head portion 11 is loosely fitted, only the head portion 11 is pulled out and the water supply bottle 12 remains on the side of the device main body 3, and water would unexpectedly leak from the head inserted portion 25 of the cover body 24*b* that constitutes the water supply body 12. If the head portion is assembled and disassembled repeatedly, the fitting force would be further reduced.

In addition, to reliably and stably mount the head portion 11 into the head inserted portion 25 of the cover body 24*b*, if an fitting length L of the head inserted portion 25 formed on the cover body 24*b* and the inserting portion 22 of the head portion 11 is increased to a certain extent as shown in FIG. 6(*b*), the axial dimension of the stain removal device 100 is increased, resulting in difficulty in structure miniaturization.

Further, when the head portion 11 is in oblique partial contact with the stain removing object W as shown by an imaginary line in FIG. 6(*b*) during use, the possibility that the head portion 11 is easy to pulled out by distortion between the inserting portion 22 and the head portion inserted portion 25 which are used as fitting portions of the head portion 11 and the cover body 24*b* should not be ignored. Particularly, when the beating washing is performed with the detergent, the case that the head portion 11 is easier to pulled out due to the fact that the detergent may penetrate into the fitting portions is also considered. In view of these factors, the length L of the head portion needs to be further increased.

In addition, although, as shown in FIG. 10 and FIG. 6, the sealing member 20 is mounted at the bottom of the stain removal device 100 to prevent the liquid from entering into screwing portions before the outer barrel 24*b*1 of the cover body 24*b* is screwed with the periphery 24*a*1 of the end portion of the bottle main body 24*a*, the number of components of the cassette mechanism 1 is increased to four.

SUMMARY

A purpose of the present disclosure is to provide a novel stain removal device which solves these problems through a smaller-sized structure for pursuing high use convenience.

To solve the above problems, the present disclosure proposes the following solution.

Namely, a stain removal device of the present disclosure includes: a cassette mechanism including a head portion having a beating surface, and a water supply bottle for accommodating liquid, where water supply paths are formed from the water supply bottle and throughout the head portion; and a device main body, which includes a vibration unit mountable by pressing the cassette mechanism and detachable by pulling out the vibration unit. The vibration unit is configured to apply a vibration to the cassette mechanism towards a direction substantially orthogonal to the beating surface of the head portion through supplied electric power. With the vibration generated by the vibration unit to the cassette mechanism, the stain removal device supplies the liquid to the beating surface of the head portion from the water supply bottle through the water supply paths. The stain removal device is characterized in that the water supply bottle of the cassette mechanism includes a bottle main body and a cover body screwed with the bottle main body so as to be capable of opening and closing, and the head portion is integrally provided on the cover body.

In this case, preferably in the present disclosure, the cover body is a bottomed member having an outer barrel screwed with an outer periphery of an end portion of the bottle main body to constitute a connection portion, a first throttling portion is formed in a region of a water supply path from a bottom of the cover body and throughout the beating surface of the head portion, and a sealing member having a second throttling portion is detachably provided in a region of a water supply path from the end portion of the bottle main body throughout the bottom of the cover body.

Alternatively, preferably in the present disclosure, the cover body and the head portion are integrally molded by resin with a narrowed portion provided between the cover body and the head portion.

Effects of the Disclosure

According to the present disclosure described above, the head portion and the cover body may be disassembled together for cleaning. Furthermore, when the cassette mechanism and the water supply bottle are pulled out of the device main body together, even if the head portion is pulled, a pull-out force from the device main body is reliably applied to the water supply bottle through screwing portions of the cover body and the bottle main. Therefore, unexpected water leakage from an opening of the cover body of the water supply bottle due to the fact that the water supply bottle remains on the device main body side may be eliminated. Further, even if the cover body is attached and detached to clean the head portion, such a phenomenon of easy removal is still avoided since the cover body and the bottle main body are screwed.

In addition, since a length corresponding to the fitting portions of the head portion and the cover body is not required, miniaturization of the stain removal device may be realized.

Further, even if the head portion is in partial contact during use, since the head portion and the cover body are integral, the possibility that only the head portion is pulled out may be reliably eliminated, and the possibility of liquid leakage or damage during drop due to distortion also may be reduced.

Particularly, such a structure is configured that the first throttling portion is arranged between the cover body and the head portion, the outer barrel of the cover body is screwed with the outer periphery of the end portion of the bottle main body, and the sealing member having the second throttling portion is sandwiched between the end portion of the bottle main body and the bottom of the cover body. According to the present disclosure described above, the first throttling portion of the sealing member may prevent the liquid leakage when the stain removal device is stopped or not used, and the screwing portions and the water supply paths are also cut off, so that the screwing portions may be prevented from being loosened easily even in a case that a detergent is used. Furthermore, since the sealing member is detachable arranged inside the cover body, the convenience for disassembling and cleaning may be further improved, and a dripping amount may be also controlled properly through the first throttling portion and the second throttling portion. Moreover, the dripping amount may be controlled just by changing the sealing member, so that the style may be varied at low cost.

In addition, the narrowed portion is arranged between the cover body and the head portion, and the cover body and the head portion are integrally made from resin. According to the present disclosure described above, on the basis of simplifying the manufacturing and reducing the number of components, the cover body and the head portion are easy to remove. Furthermore, because of integrally molding by the resin, it is possible to make it easier for the beating surface of the head portion to be copied to the stain removal object through the resin deformation of the narrowed portion.

LIST OF REFERENCE NUMERALS

1: cassette mechanism; 10: sealing member; 10*a*: water supply path; 10*a*1: second throttling portion; 11: head portion; 12: water supply bottle; 12*s*: narrowed portion; 12*x*: bottle main body; 12*y*: cover body; 12*y*1: outer barrel; 12*z*: water supply path; 12*z*1: first throttling portion; 21*a*: beating surface; and 31: vibration unit.

DETAILED DESCRIPTION

A first embodiment of the present disclosure is described below with reference to drawings.

Figure 1:
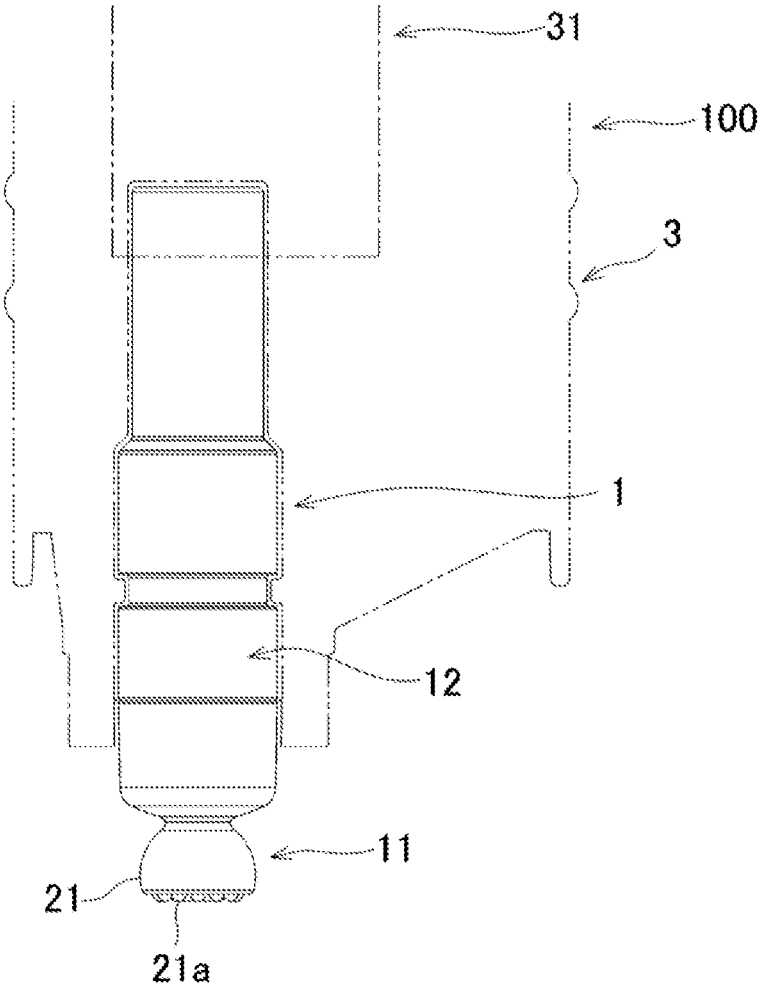
FIG. 1 is a front view illustrating a cassette mechanism of a stain removal device according to one embodiment of the present disclosure.
Figure 2:
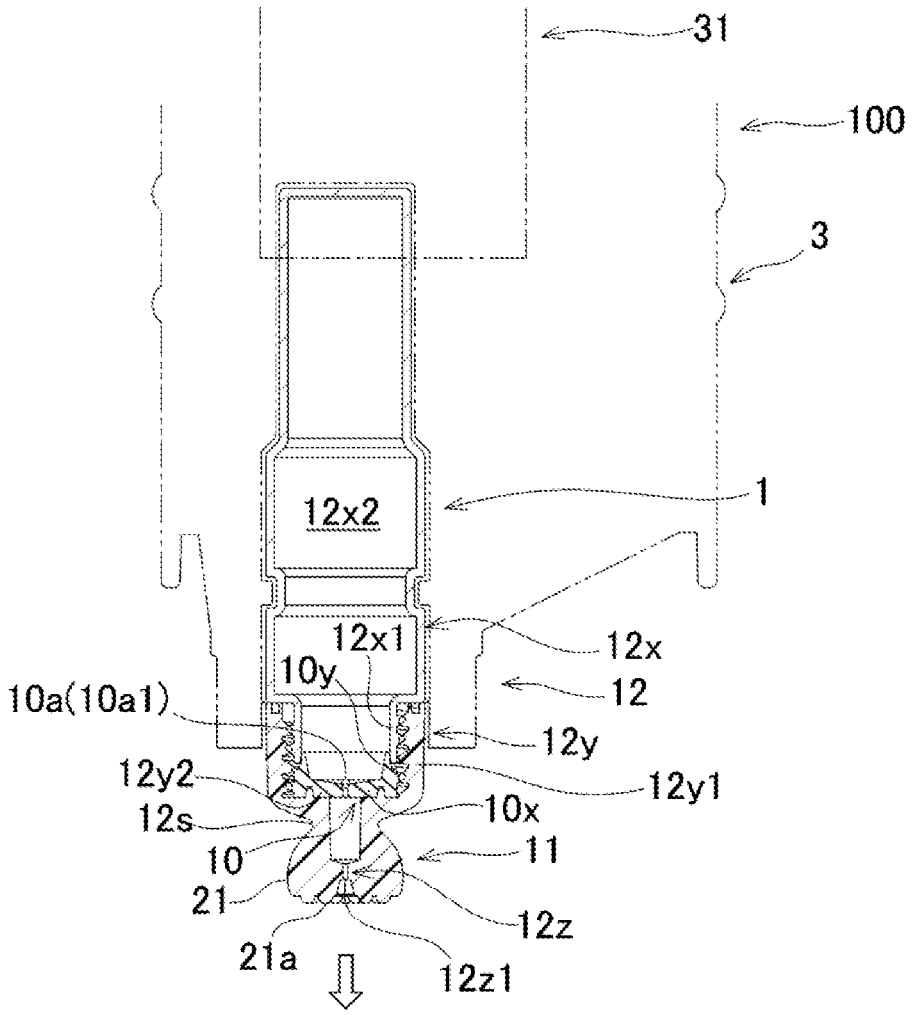
FIG. 2 is a longitudinal sectional view of the cassette mechanism.
Figure 3:
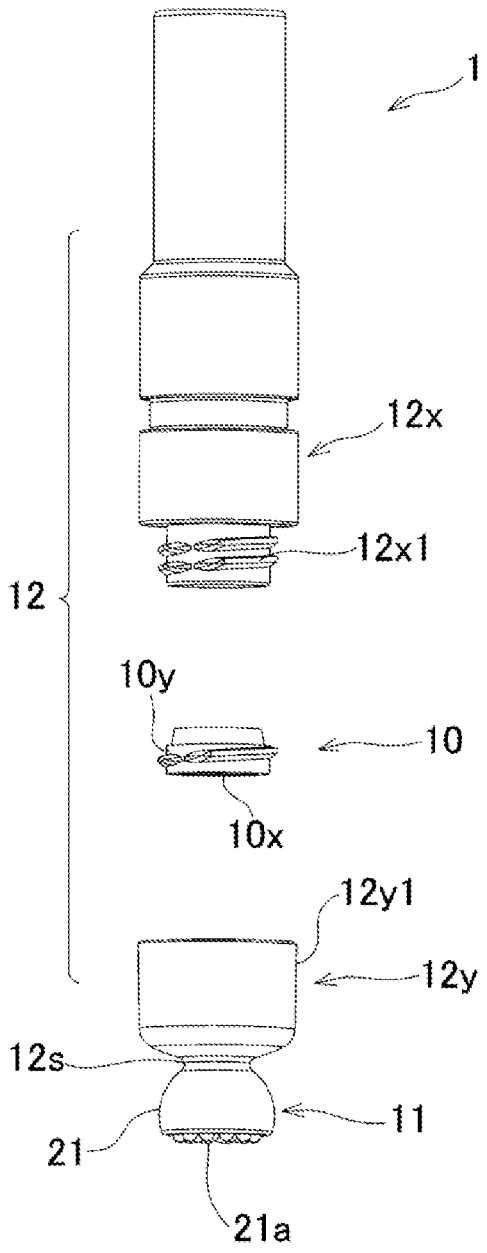
FIG. 3 is an exploded view of the cassette mechanism.
Figure 6:
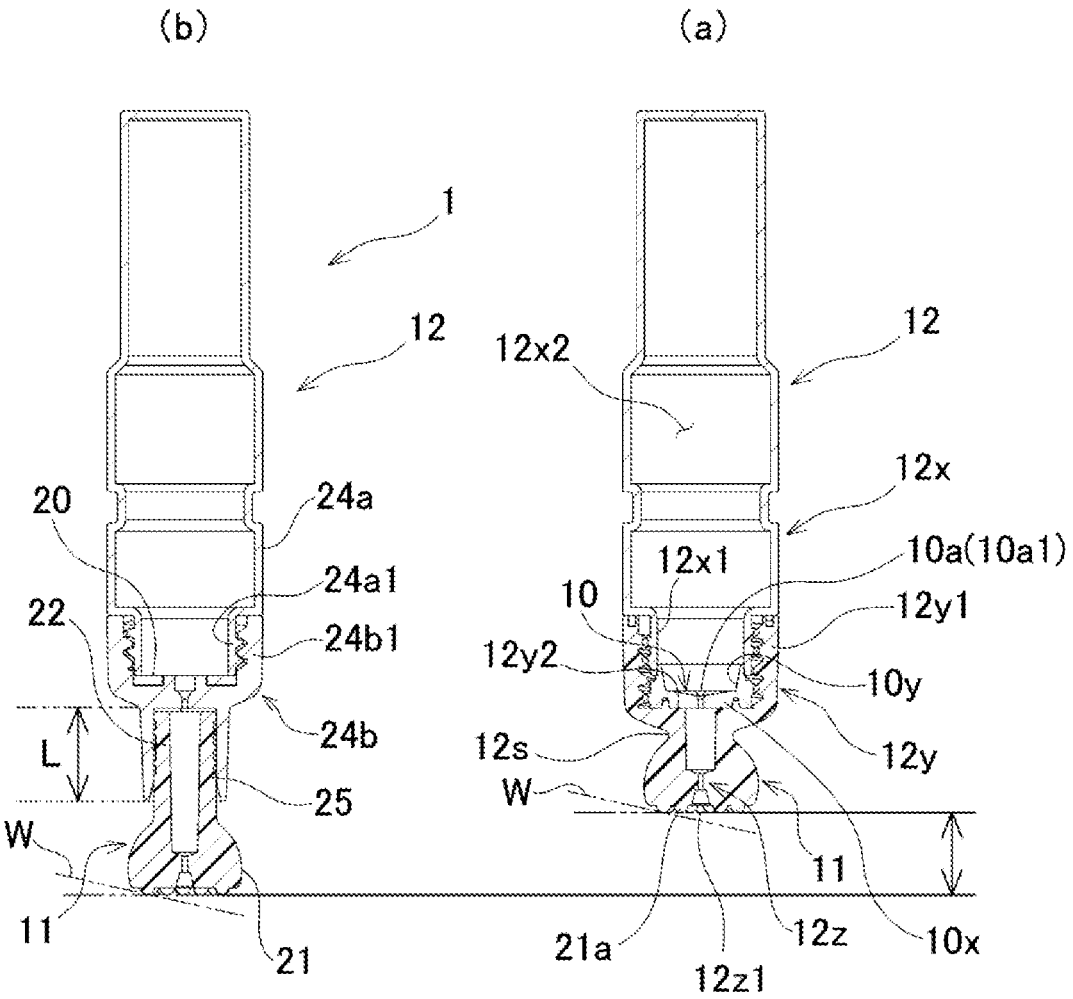
FIG. 6 is a diagram illustrating comparison between the cassette mechanism of the present embodiment and an existing structure.
Figure 7:
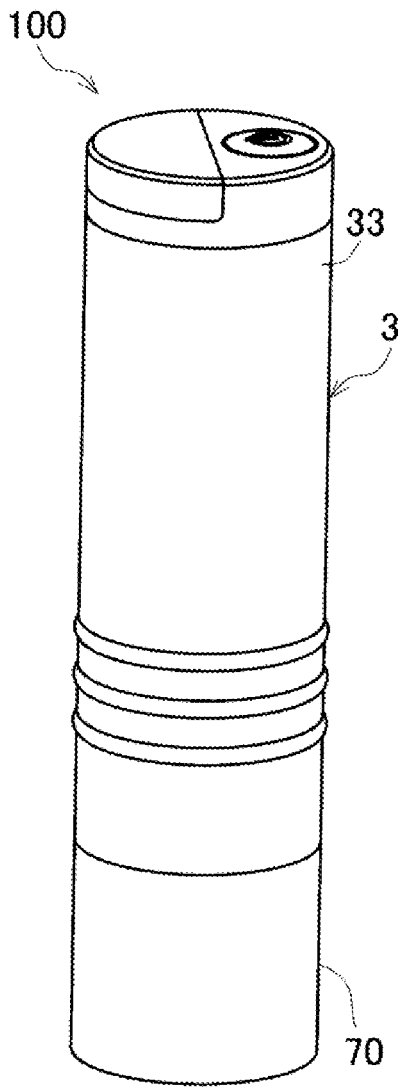
FIG. 7 is a perspective illustrating an overall appearance of a stain removal device according to an existing case.
Figure 8:
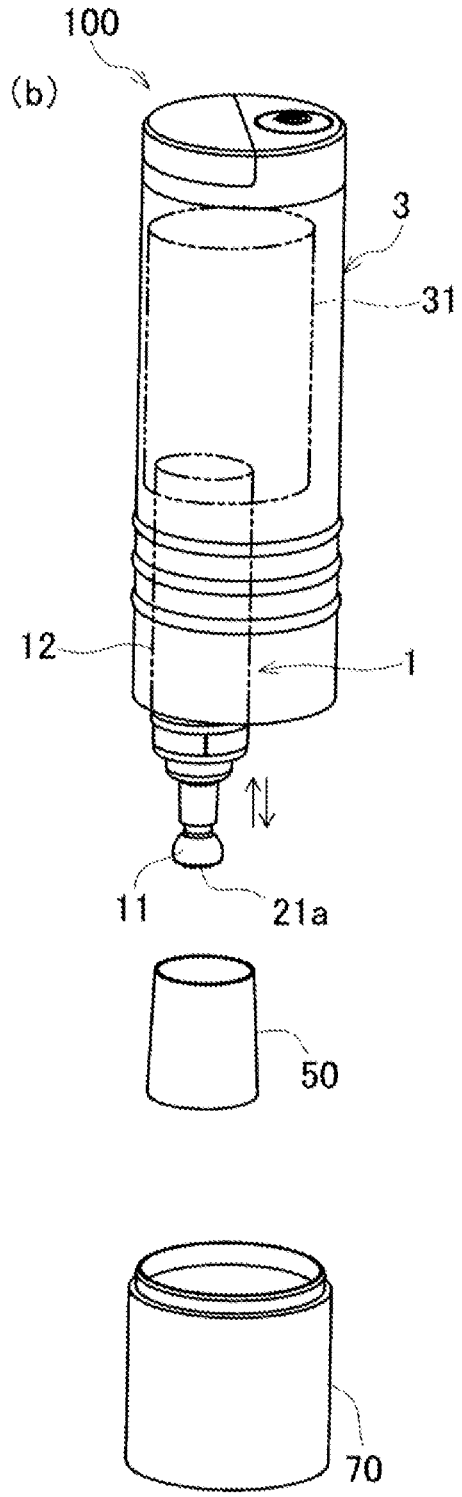
FIG. 8 is a perspective illustrating exploded structures of the stain removal device.
Figure 9:
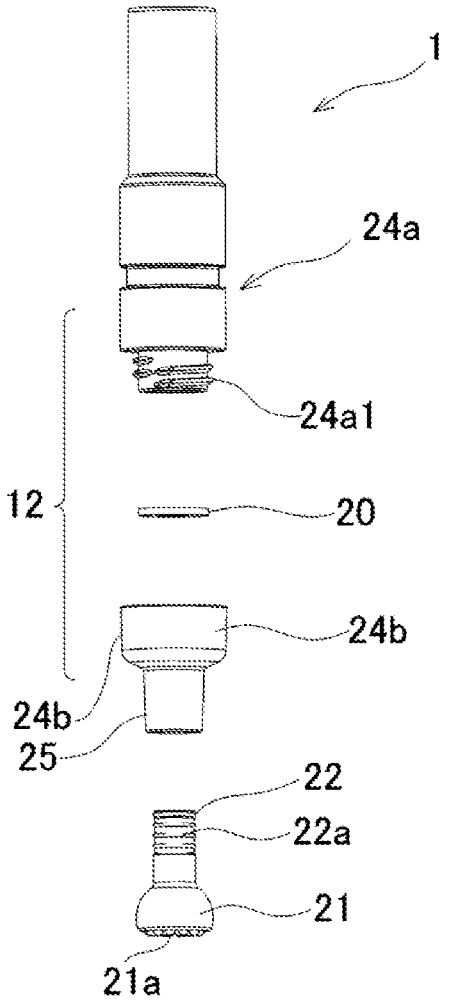
FIG. 9 is a diagram illustrating components of the stain removal device.
Figure 10:
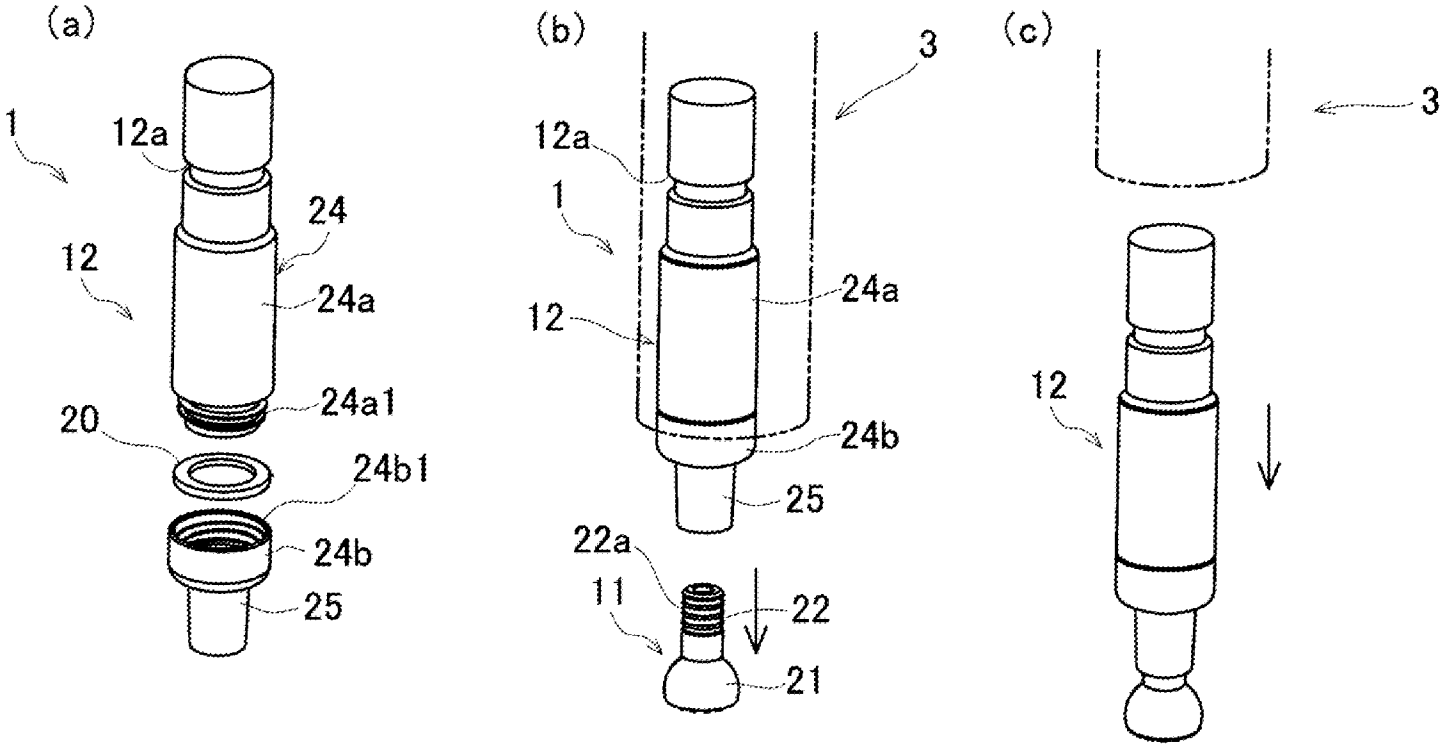
FIG. 10 is a diagram illustrating an operation state of the stain removal device.

FIG. 1 to FIG. 3 are diagrams illustrating a cassette mechanism 1 constituting a stain removal device 100 according to an embodiment of the present disclosure. Specifically, FIG. 1 is a front view illustrating the cassette mechanism 1, FIG. 2 is a longitudinal sectional view of the cassette mechanism 1, FIG. 3 is an exploded view of the cassette mechanism 1, and FIG. 6 is a diagram illustrating comparison between the cassette mechanism 1 of the present embodiment and an existing structure as shown in FIG. 8 to FIG. 10. The basic configuration of the stain removal device 100 is the same as the existing structure. The stain removal device 100 includes: the cassette mechanism 1 and a device main body. The cassette mechanism 1 is provided with a head portion 11 including a beating portion 21 having a beating surface 21*a*, and a water supply bottle 12 capable of accommodating liquid. The device main body 3 is provided with a vibration unit 31. The vibration unit 31 may be mounted by pressing the cassette mechanism 1 and be separated by pulling out, and the vibration unit 31 is configured to vibrate the cassette mechanism 1 towards a direction substantially orthogonal to the beating surface 21*a* of the head portion 11 through supplied electric power. Then, with the vibration generated by the vibration unit 31 and applied to the cassette mechanism 1, the liquid may be supplied to the beating surface 21*a* of the head portion 11 from the water supply bottle 12 through internal water supply paths.

Then, as a characteristic feature of the present embodiment, the water supply bottle 12 of the cassette mechanism 1 is composed of a bottle main body 12*x* and a bottomed barrel-shaped cover body 12*y* screwed with the bottle main body 12*x* so as to be capable of opening and closing the bottle main body 12*x*. The cover body 12*y* is integrally formed with the head portion 11, thereby preventing such a situation that only the head portion 11 is pulled out.

Specifically, the head portion 11 is a component having the bulged beating portion 21, and is integrated to the bottom of the cover body 12*y*, and a narrowed portion 12*s* is formed at the boundary portion of the head portion 11. The beating portion 21 is a member having a substantially semicircular shape in a longitudinal section, and the beating surface 21*a* is formed on the lower surface of the beating portion 21, more specifically is a member having a shape which is somewhat rounder than a semicircle.

The cover body 12*y* is a bottomed member with a thread formed at the inner circumference thereof, and the bottomed member constitutes an outer barrel 12*y*1 serving as a connecting portion with the bottle main body 12*x*. The outer barrel 12*y*1 is screwed with a cover body connection portion 12*x*1 of the bottle main body 12*x*. The liquid may be supplemented via an opening in the end portion of the bottle main body 12*x* by removing the bottle body connection portion 12*y*1 from the cover body connection portion 12*x*1 of the bottle main body 12*x*. On the cover body 12*y*, a first water supply path 12*z* having a first throttling portion 12*z*1 is formed in a region ranging from the bottom portion 12*y*2 at the inner center of the outer barrel 12*y*1 to the beating surface 11*c* of the head portion 11.

It should be noted that in the present embodiment, the head portion 11 and the cover body 12*y* are integrally formed with resin. For example, polyethylene (PP) is used as the resin, but other resin materials may be used. In addition, the head portion 11 and the cover body 12*y* also may be made of metal (for example, stainless used steel: sus) and the like in addition to the resin.

The bottle main body 12*x* includes a liquid storing portion 12*x*2 and the aforementioned cover body connection port 12*x*1. The liquid storing portion 12*x*2 is a transparent or semitransparent hollow component capable of accommodating the liquid. A side surface of the liquid storing portion 12*x*1 is partially narrowed to form a locking recessed portion 12*a*, and the locking recessed portion 12*a*, when inserted into the bottle main body 12*x*, is engaged with a locking claw (not shown) on the bottle main body 12*x* side so as to prevent the separation of the bottle main body 12*x* and the liquid storing portion 12*x*2.

In addition, a sealing member 10 having a second throttling portion 10*a*1 is detachably arranged in a region of a second water supply path 10*a* from the end portion of the bottle main body 12*x* to the bottom portion 12*y*2 of the cover body 12*y*. The sealing member 10 is tightly clamped between the end surface of the bottle main body 12*x* and the bottom 12*y*2 of the cover body 12*y*, and the water supply path 10*a* having the throttling portion 10*a*1 is formed in the center of the bottom 10*x*. Furthermore, the sealing member 10 has an upright wall 10*y* which rises from the periphery of the bottom portion 10*x* for blocking the liquid flowing through the water supply path 10*a* from entering into the screwing portions of the cover body 12*y* and the bottle main body 12*x*. As a result, the liquid in the liquid storing portion 12*x*2 drops into a gap formed between the end portion of the bottle main body 12*x* and the sealing member 10, flows down from the water supply paths 10*a* and 12*z*, and is supplied to the beating surface 21*a*.

The cover body connection portion 12*x*1 is a barrel-shaped component which is formed at the top end portion of the liquid storing portion 12*a* and has a thread at the periphery. The bottle connection portion, namely the outer barrel 12*y*1, of the cover body 12*y* is screwed with the periphery of the cover body connection portion 12*x*1. The periphery of the upright wall 10*y* of the sealing member 10 is also provided with a thread, and the thread is also screwed with the thread of the outer barrel 12*y*1 of the cover body 12*y*.

Water, a detergent mixture obtained by mixing water with detergent at a certain ratio, a common solvent such as ethanol or gasoline, a special detergent for removing stains or the like may be used as the liquid herein. In the present embodiment, only water is used as the liquid accommodated in the liquid storing portion 12*x*2.

The first water supply path 12*z* supplies the liquid in the water supply bottle body 12 to the beating surface 21*a* of the head portion 11, and is formed in a manner of penetrating head portion 11 from the liquid storing portion 12*x*2 to the beating surface 21*a*. The first throttling portion 12*z*1 having a flow path cross section smaller than that of other portions is formed near an outlet of the water supply path 12z.

The liquid dropped from the liquid storing portion 12x2 through the water supply path 10a is retained in such a water supply path 12z. When the head portion 11 is vibrated, the water supply path 12z discharges the liquid little by little at a stable flow rate (for example, 1-1.5 cc/min) to the beating surface 21a of the head portion 11 through the throttling portion 12z1. On the other hand, when the head portion 11 is not vibrated, the liquid is prevented from dripping by surface tension, particularly in the first throttling portion 12z1.

Through adopting such a head portion integral type cover body, when the water supply bottle 12 is pulled out of the device main body 3, even if the head portion 11 is pulled, a pull-out force from the device main body 3 also may be reliably applied to the water supply bottle 12 through the screwing portions of the cover body 12y and the bottle main body 12x. Therefore, such a phenomenon that only the head portion 11 is pulled out as shown in FIG. 10(b) is avoided, and an unfavorable condition of unexpected water leakage from the opening of the cover body 24b constituting the water supply bottle 12 since the water supply body 12 remains on t the device main body 3 side also may be eliminated. Further, even if the cover body 12y is detached to clean the head portion 11, since the cover body 12y and the bottle main body 12x are screwed, there is no possibility that the cover body 12y becomes easy to be removed.

In addition, compared with the existing structure shown in FIG. 6, miniaturization of the stain removal device can be realized since the length L corresponding to the fitting portions of the head portion 11 and the cover body 24b is not required.

Further, even if the head portion 11 is in partial contact with the stain removing object W during use, the possibility that the head portion 11 is twisted and falling may be reliably eliminated since the head portion 11 and the cover body 12y are integrated in the structure as shown in FIG. 6(a), and the possibility of liquid leakage or damage at the time of falling due to the twisting also may be reduced. Compared with existing configuration shown in FIG. 6(b), three components are arranged, so that the number of components may be also reduced.

Particularly, as shown in FIG. 2, the cover body 12y is a bottomed member having the outer barrel 12y1 screwed with the periphery of the end portion of the bottle main body 12x to constitute the connection portion. The first throttling portion 12z1 is formed in the first water supply path 12z of the region used as a water supply path which ranges from the bottom 12y2 of the cover body 12y to the beating surface 21a of the head portion 11. The second water supply path 10a of the region used as the water supply path which ranges from the end portion of the bottle main body 12x to the bottom 12y2 of the cover body 12y may be detachably provided with the sealing member 10 having the second throttling portion 10a1. Therefore, the liquid leakage caused when the stain removal device is stopped or not used is prevented through the first throttling portion 12z1, and the screwing portions of the cover body 12y and the bottle main body 12x are cut off from the water supply paths 10a and 12z, so that even when a detergent is used, the detergent may be prevented from entering into the screwing portions, thereby preventing the screwing portions from being loosened easily. Furthermore, since the detachable sealing member 10 is arranged at the bottom portion 12y2 of the cover body 12y, the convenience for disassembling and cleaning may be further improved, and a dripping amount may be also controlled properly through the first and second throttling portions 12z1 and 10a1. Moreover, the dripping amount may be controlled just by changing the sealing member 10, so that the style may be changed easily at low cost.

Further, when the narrowed portion 12s is arranged between the cover body 12y and the head portion 11, the cover body 12y and the head portion 11 are integrally formed by resin, so on the basis of simplifying the manufacturing and limiting the number of components, the cover body and the head portion are easy to remove. Furthermore, because the resin is integrally formed, the beating surface 21a of the head portion 11 is easily simulated on the stain removing object through the resin deformation of the narrowed portion 12s.

Figure 4:
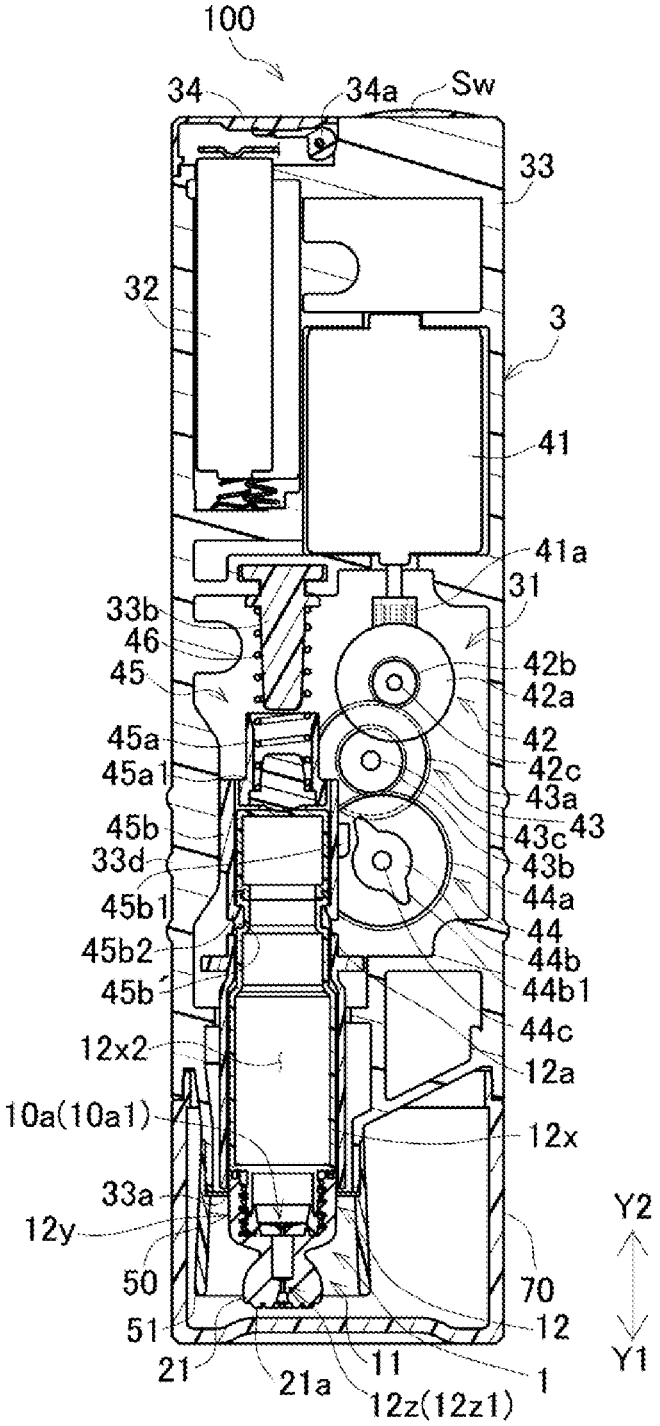
FIG. 4 is a longitudinal sectional view illustrating specific internal structures of the stain removal device.
Figure 5:
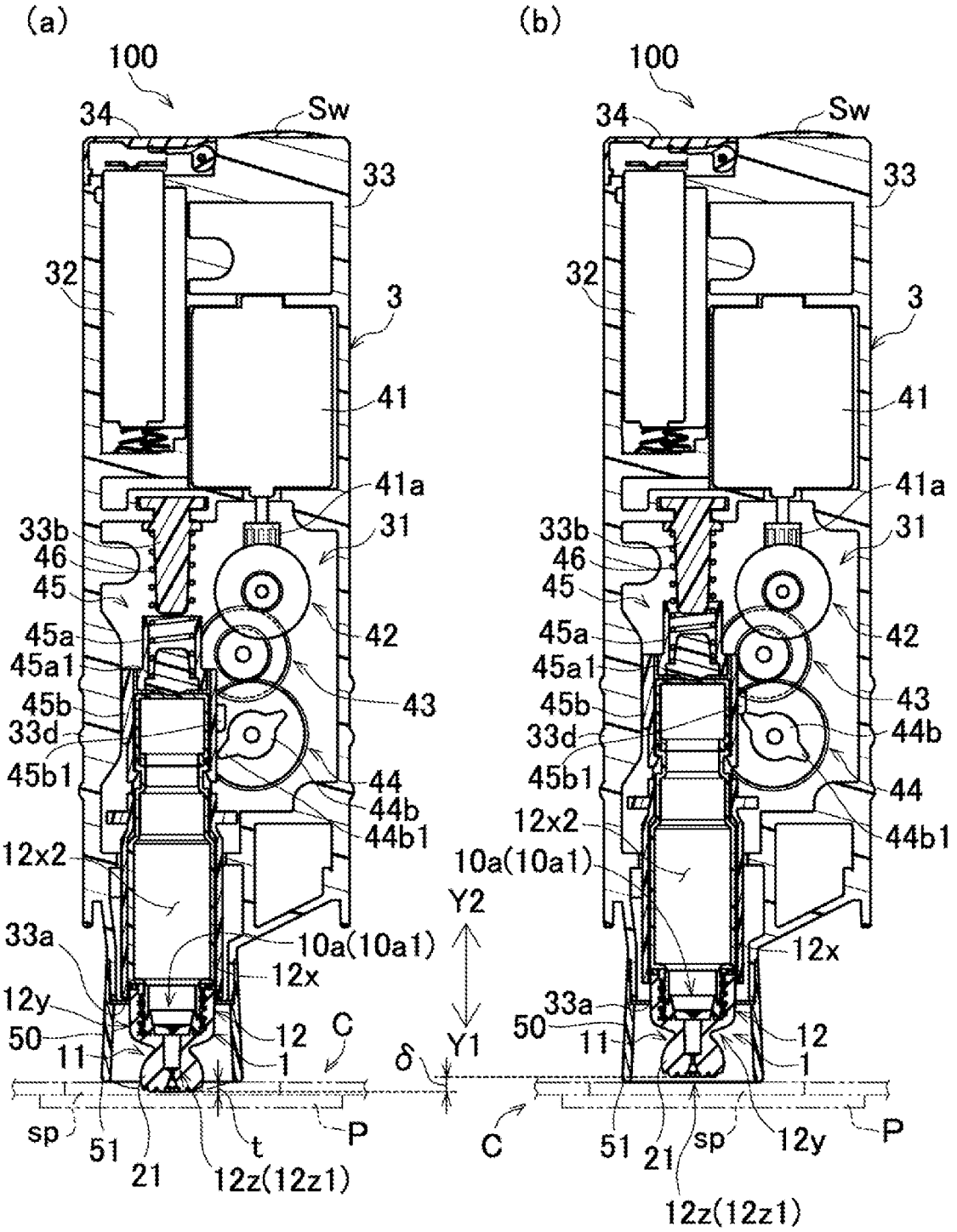
FIG. 5 is a longitudinal sectional view, corresponding to FIG. 4, illustrating the stain removal device in a use state.

Structures, which are not described in the present embodiment, of the stain removal device 100 described above are additionally described below with reference to FIG. 4, FIG. 5 and the like. Although the shapes of the water supply bottles shown in FIG. 4 and FIG. 5 are slightly different from that of the water supply bottle shown in FIG. 3, the appearance of the water supply bottle may be changed in various shapes without changing basic functions.

In the device main body 3, the vibration unit 31 for applying a vibrating force to the beating portion and a battery 32 for supplying electric power to the vibration unit are mounted on a housing main body 33 in a two part structure.

The vibration unit 31 is a component which vibrates the cassette mechanism 1 that is protruded from the housing main body 33 through an opening 33a towards a direction substantially orthogonal to the beating surface 21a of the head portion 11 through the supplied electric power. The direction substantially orthogonal to the beating surface 21a is called a vibrating direction hereinafter. In addition, in the vibrating direction, a direction where the head portion 11 protrudes towards the outside of the device is called a protruding direction Y1, and a direction opposite to this direction is called a return direction Y2. Such vibration unit 31 is provided with a motor 41, first to third gears 42 to 44, a barrel body 45 and a spiral spring 46.

The motor 41 has a driving gear 41a capable of rotating through the electric power supplied by a power supply portion, namely the battery 32.

The first to third gears 42 to 44 transmit a rotating force of the motor 41. The first gear 42 has a large-diameter portion 42a which is engaged with the driving gear 41a of the motor 41 and rotatable around a shaft 42c, and a small-diameter portion 42b coaxially integral with the large-diameter portion 42a. The second gear 43 is disposed between the first gear 42 and the third gear 44, and has a large-diameter portion 43a which is engaged with the small-diameter portion 42b of the first gear 42 and rotatable around a shaft 43c, and a small-diameter portion 43b which is integrally formed with the large-diameter portion 43a in a manner of being coaxial with the large-diameter portion 43a and is engaged with the third gear 44. The third gear 44 has a large-diameter portion 44a engaged with the small-diameter portion 43b of the second gear 43 and rotatable around a shaft 44c, and a small-diameter portion 44b integrally formed with the large-diameter portion 44a in a manner of being coaxial with the large-diameter portion 44a and is provided with two engaging protrusions 44b1 protruding at equal intervals from the end surface of the small-diameter portion 44b towards a circumferential direction. In addition, the number of engaging protrusions 44b1 is not limited to two, and may also one or more than three.

The barrel body 45 is a component which supports the cassette mechanism 1 in a manner that the beating surface 21*a* is located at the top end, and is movable towards the vibrating direction, and includes a spiral spring accommodating portion 45*a* and a cassette mechanism inserted portion 45*b*.

The spiral spring accommodating portion 45*a* is a bottomed barrel-shaped component in which a spiral spring 46 as an elastic member is accommodated in a state of being expandable and retractable in the vibration direction.

The cassette mechanism inserted portion 45*b* is a substantially cylindrical component which extends from the lower end portion of the spiral spring accommodating portion 45*a* to a vicinity of the opening 33*a* of the housing main body 33. A barrel opening 45*b*' is formed in the side surface of the cassette mechanism inserted portion 45*b*, and the side surface is provided with engaged claws 45*b*1 engageable with the engaging protrusions 44*b*1 formed at the small-diameter portion 44*b* of the third gear 44, and a locking claw 45*b*2 capable of locking the cassette mechanism 1. The locking claw 45*b*2 extend from the edge of the barrel body opening 45*b*' towards the protruding direction Y1, and the top end portion 45*b*3 protrudes towards a central axis of the cassette mechanism inserted portion 45*b* in a substantially triangular shape in longitudinal section. In addition, the locking claw 45*b*2 are configured to be elastically deformable from a base end 45*b*4 as a start point towards an outer side of the cassette mechanism inserted portion 45*b* by pressing from the cassette mechanism 1 accompanying assembling and disassembling. Such locking claws 45*b*2 are arranged at two mutually opposite positions.

One end side of the spiral spring 46 is supported by the base end side of a fixed portion 33*b* which is in a boss shape and extends from the housing main body 33 towards the protruding direction Y1, and the other end side of the spiral spring 46 is accommodated in the spiral spring accommodating portion 45*a*.

In such a state (by referring to FIG. 5(*a*)) that the engaging protrusion 44*b*1 of the third gear 44 is not engaged with the engaged claw 45*b*1, since the spiral spring 46 applies an elastic force towards the protruding direction Y1 to the bottom surface 45*a*1 of the spiral spring accommodating portion 45*a*, such a barrel body 45 may be pushed out together with the cassette mechanism 1 towards the protruding direction Y1.

In another aspect, in such a state (by referring to FIG. 5(*b*)) that the engaging protrusion 44*b*1 of the third gear 44 is engaged with the engaged claw 45*b*1, the barrel body 45 applies a compressive force to the spiral spring 46 from the bottom surface 45*a*1 along with the rotation of the third gear 44, and at the same time, moves towards the returning direction Y2 together with the cassette mechanism 1. Then, when the engaging protrusion 44*b*1 is separated from the engaged claw 45*b*1, the barrel body 45 and the cassette mechanism 1 move towards the protruding direction Y1 again through the elasticity of the compressed spiral spring 46.

Such actions are repeated to enable the cassette mechanism 1 and even the head portion 11 to be vibrated (amplitude movement). In the present embodiment, if the third gear 44 is provided with two engaging protrusions 44*b*1, the head portion 11 may reciprocate twice by one rotation.

The battery 32 is a dry battery in the present embodiment, and is accommodated in the device main body 3 through an opening/closing cover body 34 formed at one portion of the housing main body 33. The opening/closing cover body 34 is configured to rotate towards the outer side of the housing main body 33 through a pin 34*a*.

It should be noted that the vibration unit may be of various structures in addition to the structure described above. For example, an output shaft of the motor is input into a certain gear of a planetary gear mechanism, taken out from another gear at another position, and then converted into the reciprocating motion of the cassette mechanism through the rotation/reciprocating conversion mechanism, it is possible to configure that the cassette mechanism is consistent with the axial center of the housing main body.

Alternatively, if a solenoid is used in the motor, and the cassette mechanism is hold by on a movable member of the solenoid, it is possible to configure that the cassette mechanism is consistent with the axial center of the housing main body, and a speed reduction mechanism is not adopted, so that the miniaturization of the structure may be further realized.

Such a stain removal device 100 may be a hand-held-size device which may perform partial washing on clothes C as the stain removing object as shown in FIG. 4. FIG. 5 is a longitudinal sectional view illustrating a use state of the stain removal device 100. When the stain removing operation is performed, an absorbing pad P as a liner is abutted against a lower side of a stain portion Sp of the clothes C, and the stain removing detergent is directly applied to the stain portion Sp of the clothes C. Furthermore, the protruding end 51 of the waterproof cover 50 presses the clothes C at a position, which is opposite to the stain portion Sp, on the beating surface 21*a* of the head portion 11, and the stain removal device 100 is used in a such state that a vicinity of a cylindrical anti-slipping portion 33*d* of the housing main body 33 is held. In addition, the detergent may not be used in the present embodiment.

When a power switch Sw arranged on the outer side of the housing main body 33 is operated in the state, the motor 41 rotates through the electric power from the battery 32. The rotation is decelerated through the first gear 42 and the second gear 43, and is transmitted to the third gear 44. When the engaging protrusion 44*b*1 is engaged with the engaged claw 45*b*1, as shown in FIG. 4(*b*), the barrel body 45 and the cassette mechanism 1 are lifted up together by a specified size δ (about 5 mm in the present embodiment), and then, when the engaging protrusion 44*b*1 is disengaged from the engaged claw 45*b*1, the barrel body 45 and the cassette mechanism 1 are pushed out through the elasticity of the spiral spring 46, as shown in FIG. 4(*a*), and the head portion 11 beats the stain portion Sp.

In addition, the liquid and air are agitated in the liquid storing portion 24 along with the vibration of the cassette mechanism 1, so that no negative pressure is generated in the liquid storing portion 24. The liquid flows through the water supply path 13 immediately after the vibration is started, and then slowly drips, and is supplied to the stain portion Sp from the beating surface 21*a*.

When such operation is repeated while moving the device main body 3 along the clothing C, the liquid (only water, in the present embodiment) supplied to the stain portion Sp and the detergent coated on the stain portion Sp together dissolve the dirt that constitutes the stain portion Sp, and the liquid, the detergent and the dirt are beaten out from the clothes C and absorbed by the absorbing pad P. Namely, the stain removal device 100 is a device capable of removing the stains by transferring the dirt of the clothes C, the liquid and the detergent together to the absorbing pad P.

In addition, in the present embodiment, it is effective to continue the above-described operation for a certain period of time even after stains have been removed, so that the detergent remaining on the stain portion Sp is transferred to the absorbing pad P, and a rinsing effect may be achieved.

In addition, no special limitation is made to the absorbing pad P. Various objects may be used as long as the liquid absorption speed is high. For example, a product obtained by folding kitchen paper may be used.

Further, the dripping liquid may be stably absorbed by the absorbing pad P by regularly performing such operation of changing a position where the head portion 11 is abutted against the absorbing pad P in the stain removing operation, so a state of high stain removing efficiency may be kept.

The vibration unit 31 vibrates the cassette mechanism 1 in the direction substantially orthogonal to the beating surface 21*a* through the supplied electric power, and the head portion 11 may automatically make the action of beating the clothes C, so that the stain removal device 100 of the above structure has excellent effects that the beating force and the beating speed are uniform, and a user does not need to move a hand rapidly, and the hand is not tired even if the stain removing operation is performed for a long time.

In addition, although the stains may be block-shaped solid dirt attached to the clothes C which is difficult to be dissolved by the liquid, the stain removal device 100 may physically decompose the solid dirt through impact from the head portion 11 and enable the solid dirt to be dissolved in the liquid. In addition, for example, by a proper design of the cross sections of flowing paths of the water supply paths 10*a* and 12*z*, a proper amount of the liquid is continuously supplied to the clothes C along with the vibration, so that the stain removing effect may be enhanced. Further, compared with a device for pumping out the liquid by using a liquid pump, the stain removal device 100 has a simplified structure and a reduced size since the stain removal device 100 is of such a structure that the liquid drips through the vibration.

Therefore, the stain removal device 100 of the present embodiment is a compact and has good portability. When food residues, cosmetics and the like are attached to a cloth product outside, stains may be made inconspicuous by partial washing. In addition, articles such as curtains and carpets which are difficult to be washed on the whole may be partially washed properly. Further, the stain removal device 100 also may be applicable to cleaning objects before the objects are washed in a washing machine. The stain removal device 100 is used for pre-cleaning dirt on necks, sleeves and the like of the clothes C.

Although embodiments of the present disclosure are described above, specific structures of all parts are not limited to the above-mentioned embodiments. Various variations can also be made without departing from the scope of the technical spirit of the present disclosure.

What is claimed is:

1. A stain removal device, comprising:

a cassette mechanism, which comprises a head portion having a beating surface and a water supply bottle for accommodating liquid, wherein water supply paths are formed from the water supply bottle and throughout the head portion; and a device main body, which comprises a vibration unit, wherein the vibration unit is mounted by pressing the cassette mechanism and detached by pulling out the vibration unit and is configured to apply a vibration to the cassette mechanism towards a direction substantially orthogonal to the beating surface of the head portion through supplied electric power, wherein with the vibration generated by the vibration unit to the cassette mechanism, the stain removal device supplies the liquid to the beating surface of the head portion from the water supply bottle through the water supply paths, wherein the water supply bottle of the cassette mechanism comprises a bottle main body and a cover body screwed with the bottle main body so as to be capable of opening and closing, and the head portion is integrally provided on the cover body, wherein the cover body is a bottomed member having an outer barrel screwed with an outer periphery of an end portion of the bottle main body to constitute a connection portion, the water supply paths comprises a first water supply path from a bottom of the cover body and throughout the beating surface of the head portion and a second water supply path from the end portion of the bottle main body throughout the bottom of the cover body, a first throttling portion is formed in a region of the first water supply path, and a sealing member having a second throttling portion is detachably provided in a region of the second water supply path, the scaling member is tightly clamped between an end surface of the bottle main body and a bottom of the cover body, and the sealing member has a bottom portion and an upright wall which rises from a periphery of the bottom portion for blocking liquid flowing through the second water supply path from entering into screwing portions of the cover body and the bottle main body.

2. The stain removal device according to claim 1, wherein the cover body and the head portion are integrally molded by resin with a narrowed portion provided between the cover body and the head portion.

* * * * *